US010005532B2

(12) United States Patent
Smith et al.

(10) Patent No.: US 10,005,532 B2
(45) Date of Patent: Jun. 26, 2018

(54) RETRACTABLE THRUSTER

(71) Applicant: LEWMAR LIMITED, Hampshire (GB)

(72) Inventors: Nigel Christopher Smith, Warsash (GB); Philip David Roberts, Fareham (GB); Andrew Michael Matthews, Petersfield (GB)

(73) Assignee: LEWMAR LIMITED, Hampshire (GB)

( * ) Notice: Subject to any disclaimer, the term of this patent is extended or adjusted under 35 U.S.C. 154(b) by 0 days. days.

(21) Appl. No.: 15/347,410

(22) Filed: Nov. 9, 2016

(65) Prior Publication Data

US 2017/0137099 A1 May 18, 2017

(30) Foreign Application Priority Data

Nov. 12, 2015 (GB) ..... 1519998.7

(51) Int. Cl.
*B63H 5/125* (2006.01)
*B63H 5/14* (2006.01)

(52) U.S. Cl.
CPC ..... *B63H 5/125* (2013.01); *B63H 5/14* (2013.01)

(58) Field of Classification Search
CPC ..... B63H 5/125; B63H 5/14
USPC ..... 114/151
See application file for complete search history.

(56) References Cited

U.S. PATENT DOCUMENTS

2006/0060127 A1 3/2006 Fontanille et al.

FOREIGN PATENT DOCUMENTS

| | | |
|---|---|---|
| DE | 19601226 | 7/1997 |
| EP | 1512623 | 3/2005 |
| EP | 2548797 | 1/2013 |
| EP | 2757037 | 7/2014 |
| GB | 2092974 | 8/1982 |
| WO | WO 98/13257 | 4/1998 |

OTHER PUBLICATIONS

"Lewmar Marine Equipment Guide", LEWMAR, Issue 3, pp. 36-46, Copyright 2010.

*Primary Examiner* — Stephen P Avila
(74) *Attorney, Agent, or Firm* — Leason Ellis LLP

(57) ABSTRACT

A thruster assembly is provided for a marine vessel, the assembly having a propeller unit (14), a motor (10) and a drive shaft (12) linking the motor (10) with the propeller unit (14) to drive the propeller unit (14). The drive shaft (12) is foldable and defines a drive path between the motor (10) and the propeller unit (14). A housing (2) locates the propeller unit (14) in a storage configuration. The motor (10) is fixed with respect to the housing (2), the housing (2) being adapted to be fixed with respect to an opening in a hull (8) of the marine vessel. An actuator (22) is operable to move the propeller unit (14) from the storage configuration to a deployment configuration in a direction from inboard to outboard, the propeller unit (14) being extended from the hull (8) for use in the deployment configuration. The propeller unit (14) is supported by a support assembly (36) which is pivotable relative to the housing (2) about a pivot axis (A).

33 Claims, 10 Drawing Sheets

RETRACTABLE THRUSTER

CROSS-REFERENCE TO RELATED APPLICATIONS

The present application claims priority under 35 U.S.C. § 119 to British Patent Application No. 1519998.7, filed Nov. 12, 2015, which is hereby incorporated by reference in its entirety.

BACKGROUND TO THE INVENTION

Field of the Invention

The present invention relates to the field of thrusters for marine vessels, such as power boats and sailboats, typically used as leisure craft. More particularly, it relates to thrusters that are able to move between a deployed position when in use, and a retracted position when not in use. In the art, these thrusters have previously been known as 'swing' thrusters, but are more properly referred to as retractable thrusters.

Related Art

It is known that addition of thrusters to marine vessels improves their manoeuvrability. This is of particular advantage when, for example, manoeuvring within a port or harbour, where space is often limited, and manoeuvring takes place at low speed.

Thrusters use a pair of cooperating propellers, driven by an electric or hydraulic motor, in order to provide a thrust of water in the required lateral direction.

Various types of thruster are known in the art already. Bow thrusters are used to control lateral movement of the bow. One type of bow thruster is a tunnel thruster, in which a tunnel is installed laterally through the bow region of the hull. Tunnel thrusters are generally used for larger vessels. The tunnel is installed in the hull below the waterline. This takes up a large amount of internal space and so this approach is not considered suitable for smaller vessels where hull space is often limited.

For smaller vessels, or for vessels having a hull designed for planing, in which the bow part of the hull may have a very shallow draft, an alternative approach lies in a retractable thruster. A retractable thruster is held within the hull when not in use, in a storage configuration, in order to avoid effects of drag. The retractable thruster is extended outboard from the hull when needed, in a deployment configuration. It is in view of the type of motion employed to deploy the thruster that some such thrusters have previously been referred to as 'swing' thrusters.

Known retractable thrusters have the propellers located in a tunnel, the propellers being mounted on a common shaft in the tunnel, the common shaft being connected by a drive shaft to a motor (typically electric but optionally hydraulic) and a deployment mechanism for moving the tunnel with its associated propellers and the drive shaft between the storage and deployment configurations. Typically, the deployment mechanism includes an actuator.

EP-B-1512623 discloses a steering device comprising a propeller unit attached at a first end of a main carrying arm, and a motor attached at a second end of the main carrying arm. The main carrying arm is arranged to pivot through a recess in a rigid housing. In operation, therefore, both the motor and the propeller unit rotate between the storage and deployment configurations. In order to accommodate this movement, a flexible sealing ring is provided between the main carrying arm and the housing.

EP-B-2548797 discloses a retractable thruster comprising a propeller unit arranged for moving along an arc about a first centre of rotation between a retracted and an extended position. A door is attached to the propeller unit. The door is arranged to be rotated about a second centre of rotation opposite to that of the rotation of the propeller unit. EP-B-2548797 also provides a motor which is fixed in an upright position relative to the hull of the vessel. The drive shaft linking the motor and propeller unit has a foldable double cardan joint in order to accommodate the movement of the propeller unit relative to the motor.

SUMMARY OF THE INVENTION

The present inventors have realised that known retractable thrusters could be improved substantially. The present inventors consider that a retractable thruster should have a low profile in the hull of the vessel, both in the storage configuration and in the deployment configuration. The motor, the deployment mechanism and the propeller unit should take up as small amount of space inside the hull as possible, and in particular as small amount of height as possible. It would also be advantageous for the position of the motor to be fixed. Where there is a need to accommodate movement of the motor, e.g. between the storage and deployment configurations, there must be available space to accommodate that movement. Furthermore, the movement of a relatively bulky component such as a motor represents a health and safety consideration. Moreover, movement of the motor and its associated wiring presents the risk of increased wear and tear and thus failure.

The present inventors have also realised that special consideration should be given to the path of travel of the propeller unit between the storage and deployment configurations. This is necessary in order to ensure that the shape of the hull is suitable or can be adapted accordingly. It is particularly advantageous to ensure that there is suitable clearance between the hull and the path of travel of the propeller unit, without the need for a severe chamfer being applied to the hull.

The present invention has been devised in order to address at least one of the above problems. Preferably, the present invention reduces, ameliorates, avoids or overcomes at least one of the above problems.

In a general aspect, the present invention moves the propeller unit from the storage configuration to the deployment configuration by pivoting about a pivot axis which is located in a more outboard direction, or closer to the hull, than previously used. This permits the movement of the propeller unit to interfere with the hull design in a more limited manner than previously, and also allows the assembly to take up less space in the hull.

Accordingly, in a first preferred aspect, the present invention provides a thruster assembly for a marine vessel comprising:

- a propeller unit;
- a motor;
- a drive shaft linking the motor with the propeller unit to drive the propeller unit, the drive shaft being foldable and defining a drive path between the motor and the propeller unit;
- a housing for locating the propeller unit in a storage configuration, the motor being fixed with respect to the housing, the housing being adapted to be fixed with respect to an opening in a hull of the marine vessel;
- an actuator operable to move the propeller unit from the storage configuration to a deployment configuration in a direction from inboard to outboard, the propeller unit being extended from the hull for use in the deployment configuration, wherein the propeller unit is supported by a support assembly which is pivotable relative to the housing about a pivot axis, a closest point on the drive path being defined as a point on the drive path which is closest to the pivot axis, the pivot axis being located in a position which is outboard of the closest point on the drive path, when the propeller unit is in the storage configuration and when the propeller unit is in the deployment configuration.

By the location of the pivot axis relative to the drive path, the thruster assembly can be provided with a low profile, due to the low pivot design relative to the hull.

For a non-foldable, straight drive shaft, the drive path would be coincident with the axis of rotation of the drive shaft. For a foldable drive shaft, the drive path is considered to lie along a line joining the centre of rotation of each component piece of the foldable drive shaft. At the limit where the drive shaft is formed of flexible material, for example, the drive shaft can be notionally divided into a series of sections taken perpendicular to the local rotational axis, and the drive path can be considered to lie along a line joining the centre of rotation of each section.

The pivot axis position is defined relative to the closest point on the drive path for a particular position of the drive shaft. That is, for a particular position of the drive shaft, the drive path can be plotted, and the closest point on the drive path to the pivot axis can be determined for that position of the drive shaft.

It will be understood that the drive path defined by the drive shaft is independent of the diameter of the drive shaft. The drive shaft preferably moves and changes shape as the thruster moves from the storage configuration to the deployment configuration, and so the drive path correspondingly moves, with the drive shaft, between the storage and the deployment configurations.

The terms 'inboard' and 'outboard' are used here in a relative sense. A position is 'inboard' when that position is within the hull of the vessel. A position is 'outboard' when that position is outside the hull of the vessel. However, a position can be defined as 'outboard of' or 'more outboard than' another position, meaning that it is located towards the outboard direction relative to the inboard direction, without necessarily being located outside the hull of the vessel. Similarly, a position can be defined as 'inboard of' or 'more inboard than' another position, meaning that it is located towards the inboard direction relative to the outboard direction, without necessarily being located inside the hull of the vessel. In this way, 'inboard' and 'outboard' define a direction system.

In a second preferred aspect, the present invention provides a marine vessel fitted with a retractable thruster assembly, the marine vessel having a hull, the thruster assembly comprising:

a propeller unit;

a motor;

a drive shaft linking the motor with the propeller unit to drive the propeller unit, the drive shaft being foldable and defining a drive path between the motor and the propeller unit;

a housing for locating the propeller unit in a storage configuration, the motor being fixed with respect to the housing, the housing being fixed with respect to an opening in the hull of the marine vessel;

an actuator operable to move the propeller unit from the storage configuration to a deployment configuration, the propeller unit being extended from the hull for use in the deployment configuration, wherein the propeller unit is supported by a support assembly which is pivotable relative to the housing about a pivot axis, a closest point on the drive path being defined as a point on the drive path which is closest to the pivot axis, the pivot axis being located in a position which is closer to the hull compared with distance between the hull and the closest point on the drive path, when the propeller unit is in the storage configuration and when the propeller unit is in the deployment configuration.

In a third preferred aspect, the present invention provides a thruster assembly for a marine vessel comprising:

a propeller unit;

a motor;

a drive shaft linking the motor with the propeller unit to drive the propeller unit;

a housing for locating the propeller unit in a storage configuration, the motor being fixed with respect to the housing, the housing having a flange configured to be fixed with respect to an opening in a hull of the marine vessel, wherein when the housing is oriented upright, the flange is downwards-facing;

an actuator operable to move the propeller unit from the storage configuration to a deployment configuration in a direction from inboard to outboard, the propeller unit being extended from the hull for use in the deployment configuration, wherein the propeller unit is supported by a support assembly which is pivotable relative to the housing about a pivot axis, wherein when the housing is oriented upright, the pivot axis is located in a position downwardly from the flange of the housing.

In a fourth preferred aspect, the present invention provides a marine vessel fitted with a retractable thruster assembly, the marine vessel having a hull, the thruster assembly comprising:

a propeller unit;

a motor;

a drive shaft linking the motor with the propeller unit to drive the propeller unit;

a housing for locating the propeller unit in a storage configuration, the motor being fixed with respect to the housing, the housing having a flange fixed with respect to an opening in a hull of the marine vessel, wherein when the housing is oriented upright, the flange is downwards-facing;

an actuator operable to move the propeller unit from the storage configuration to a deployment configuration in a direction from inboard to outboard, the propeller unit being extended from the hull for use in the deployment configuration, wherein the propeller unit is supported by a support assembly which is pivotable relative to the housing about a pivot axis, wherein when the housing is oriented upright, the pivot axis is located in a position downwardly from the flange of the housing.

Accordingly, in a fifth preferred aspect, the present invention provides a thruster assembly for a marine vessel comprising:

a propeller unit;

a motor;

a drive shaft linking the motor with the propeller unit to drive the propeller unit;

a housing for locating the propeller unit in a storage configuration, the motor being fixed with respect to the housing, the housing being adapted to be fixed with respect to an opening in a hull of the marine vessel;

an actuator operable to drive a rotatable actuator shaft, rotatable about an actuator shaft rotation axis, to move the propeller unit from the storage configuration to a deployment configuration in a direction from inboard to outboard, the propeller unit being extended from the hull for use in the deployment configuration, wherein the propeller unit is supported by a support assembly which is pivotable relative to the housing about a pivot axis, the pivot axis being located in a position which is outboard of the actuator shaft rotation axis.

In a sixth preferred aspect, the present invention provides a marine vessel fitted with a retractable thruster assembly, the marine vessel having a hull, the thruster assembly comprising:

a propeller unit;

a motor;

a drive shaft linking the motor with the propeller unit to drive the propeller unit;

a housing for locating the propeller unit in a storage configuration, the motor being fixed with respect to the housing, the housing being fixed with respect to an opening in a hull of the marine vessel;

an actuator operable to drive a rotatable actuator shaft, rotatable about an actuator shaft rotation axis, to move the propeller unit from the storage configuration to a deployment configuration in a direction from inboard to outboard, the propeller unit being extended from the hull for use in the deployment configuration, wherein the propeller unit is supported by a support assembly which is pivotable relative to the housing about a pivot axis, the pivot axis being located in a position which is outboard of the actuator shaft rotation axis.

In a seventh preferred aspect, the present invention provides a method for installing a retractable thruster assembly according to the first aspect, the third aspect or the fifth aspect into a marine vessel, the method including the step of providing an opening in a hull of the marine vessel and fixing the housing of the retractable thruster assembly with respect to the opening.

In an eighth preferred aspect, the present invention provides a kit of parts, comprising a retractable thruster assembly according to the first aspect, the third aspect or the fifth aspect, and an insert unit, the insert unit being for installation at a corresponding hole formed in a hull of a marine vessel, the insert unit and the housing being adapted to be sealingly attached to each other.

The first, second, third, fourth, fifth, sixth, seventh and/or eighth aspect of the invention may be combined together in any combination and/or may have any one or, to the extent that they are compatible, any combination of the following optional features.

The motor may be electric, hydraulic, or any other type of motor suitable for driving the propeller unit. Preferably, the motor is electric.

In the first, second, fifth and/or sixth aspects, as in the third and fourth aspects, preferably, the housing comprises a downwards-facing flange configured to be fixed relative to an opening in the hull of the vessel. The housing is preferably fixed, via the downwards-facing flange in a sealing engagement with a corresponding upwards-facing flange formed in an insert unit suitable for bonding into the hull of the marine vessel. The sealing engagement may comprise a gasket placed between the two flanges, for example. This arrangement allows for a suitable seal, preventing ingress of water, whilst also allowing ease of installation and disassembly to permit maintenance and/or replacement of the thruster. Preferably the housing is formed from glass reinforced plastic (GRP) or poly(methyl methacrylate) (PMMA).

The housing is preferably shaped so as to at least partly conform to the shape of the components situated inside it, in order to reduce the profile of the thruster assembly inside the hull of the boat. However, the housing may take any suitable shape, preferably a shape which provides a desired low profile.

The propeller unit comprises a propeller shaft with at least one, but preferably two, propellers. The propellers are preferably located at opposing ends of the propeller shaft. The drive shaft typically engages with gearing to drive the propeller shaft. The shape and size of the at least one propeller may be selected to suit the vessel, and will affect the force and direction of the lateral thrust produced by the propeller unit. The force and direction of the lateral thrust produced will also depend on the speed and direction of the rotation of the propeller shaft, as driven by the motor. Preferably the speed and direction of the rotation of the propeller shaft as driven by the motor is selectable when the thruster is operated, and may take a wide range of values. This has the advantage that different amounts of thrust can be selected as required to manoeuvre a vessel in different situations, when the thruster is installed in a marine vessel.

Preferably the propeller unit sits within a tunnel. The tunnel offers protection for the propeller unit, and allows ease of attachment of other components, for example a cover (discussed in more detail below). The tunnel may, for example, be formed from glass reinforced plastic. Preferably a cover is connected to the tunnel via a connecting means. The purpose of the cover is to cover the opening in the hull when the thruster assembly is in the storage configuration. Preferably the connecting means is a bracket, formed for example from folded metal sheet, but may be any other arrangement suitable for fixing the cover to the tunnel. Preferably the connecting means permits adjustment of the position of the cover relative to the tunnel, and therefore relative to the opening in the hull. It is not intended, however, that such adjustment would take place during operation of the thruster. In one embodiment of the invention, suitable adjustment can achieved by an arrangement of slots in the bracket, allowing repositioning of the cover.

The cover preferably has a surface finish adapted to be similar to the surface finish of the hull. This is primarily for aesthetic reasons, but it is also considered that the surface finish can affect flow of water across the cover, and it is preferable that this flow is as similar as possible to flow over the hull, to reduce drag effects when the thruster assembly is in the storage configuration.

Preferably, in addition to the drive shaft linking the motor with the propeller unit being foldable, the drive shaft is also telescopic. The foldability of the drive shaft may be provided by one or more foldable joints.

Preferably, the drive shaft comprises a driving shaft connected to the motor and a telescopically extendable intermediate shaft assembly, with a foldable joint connecting the driving shaft and the intermediate shaft assembly. The intermediate shaft assembly preferably comprises a splined sleeve cooperating with a splined shaft, the splined shaft being extendable from the splined sleeve whilst maintaining torque transmission from the splined sleeve to the splined shaft. Preferably, the intermediate shaft assembly is connected to a driven shaft for driving the propeller unit. A foldable joint may be provided between the intermediate shaft assembly and the driven shaft. The one or more foldable joints may be any suitable torque-transmitting foldable joint. For example, the foldable joint may be a universal joint, such as a standard universal joint, a Cardan joint, a double Cardan joint, a constant velocity joint, or similar.

The folding nature of the drive shaft assists in the operation of the invention by permitting space-efficient storage of the thruster assembly. When the thruster assembly is moved from the storage configuration to the deployment configuration, at least part of the drive path also moves, by virtue of at least partial unfolding of the drive shaft. For efficient use of space, preferably the drive shaft folds and unfolds at least at a location relatively close to the motor. This can be considered with reference to the closest point on the drive path (being defined, as above, as a point on the drive path which is closest to the pivot axis), which preferably moves along the drive path as the thruster assembly is moved from the storage configuration to the deployment configuration. Still more preferably, the movement direction of the closest point on the drive path as the thruster assembly is moved from the storage configuration to the deployment configuration is in a direction along the drive path from the motor towards the propeller unit.

It is preferable that at the start of deployment, the movement of the propeller unit is substantially perpendicular to the hull of the marine vessel, or if the hull is non-planar, substantially perpendicular to a tangent to the hull at the point where the opening is formed in the hull. This allows for more vertical downwards or outboard motion at the start of deployment, meaning that an excessive chamfer on the hull can be avoided.

The actuator may be hydraulic, electric, or pneumatic, or any other type of actuator operable to move the propeller unit from a storage to a deployment configuration. Preferably the actuator is hydraulic. The actuator may operate to move an actuator rod in a linear fashion.

The mechanism by which the actuator moves the propeller unit from a storage to a deployment configuration may be any suitable mechanism that allows the required movements of components of the thruster assembly whilst retaining a low profile format for the thruster assembly. The actuator may operate to rotate an actuator shaft, rotatable about an actuator shaft rotation axis, as set out with respect to the fifth and sixth aspects. The actuator shaft preferably extends through the housing via a watertight rotatable seal. The pivot axis of the support assembly is preferably offset from the actuator shaft rotation axis (i.e. is preferably not coaxial with the actuator shaft rotation axis), allowing the pivot axis to be located in a position which is outboard of the actuator shaft rotation axis. A mechanical linkage is typically provided between the actuator shaft and the support assembly. Any suitable linkage can be used, for example an arrangement of a crank, pivot and lever.

Further optional features of the invention are set out below.

BRIEF DESCRIPTION OF THE DRAWINGS

Embodiments of the invention will now be described by way of example with reference to the accompanying drawings. All of the figures depict one preferred embodiment of the invention in which.

Figure 1:
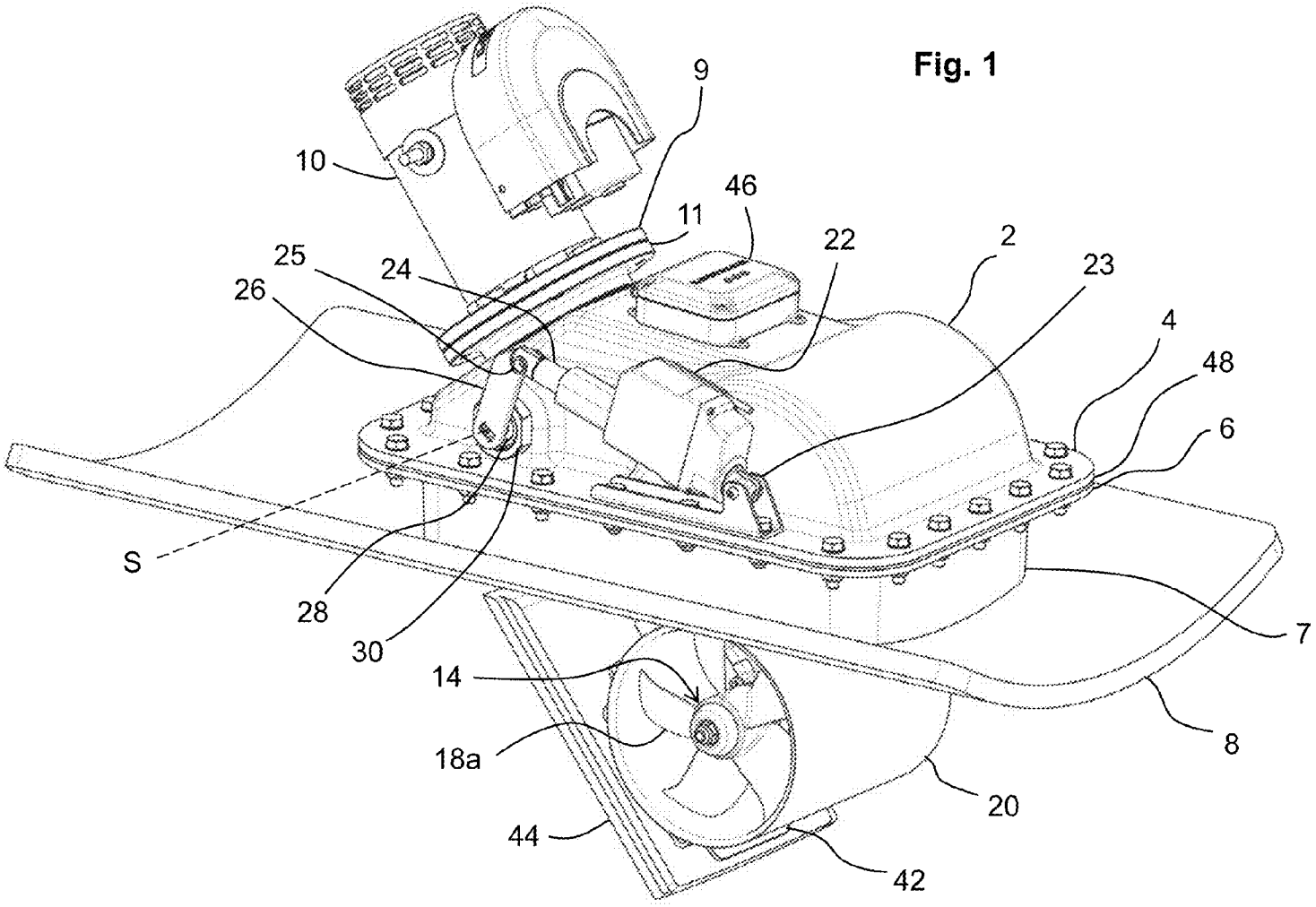
FIG. 1 shows an isometric view of the retractable thruster assembly, including part of the hull of a vessel to which the retractable thruster is fixed, with the support assembly and propeller unit in a deployed configuration.
Figure 2:
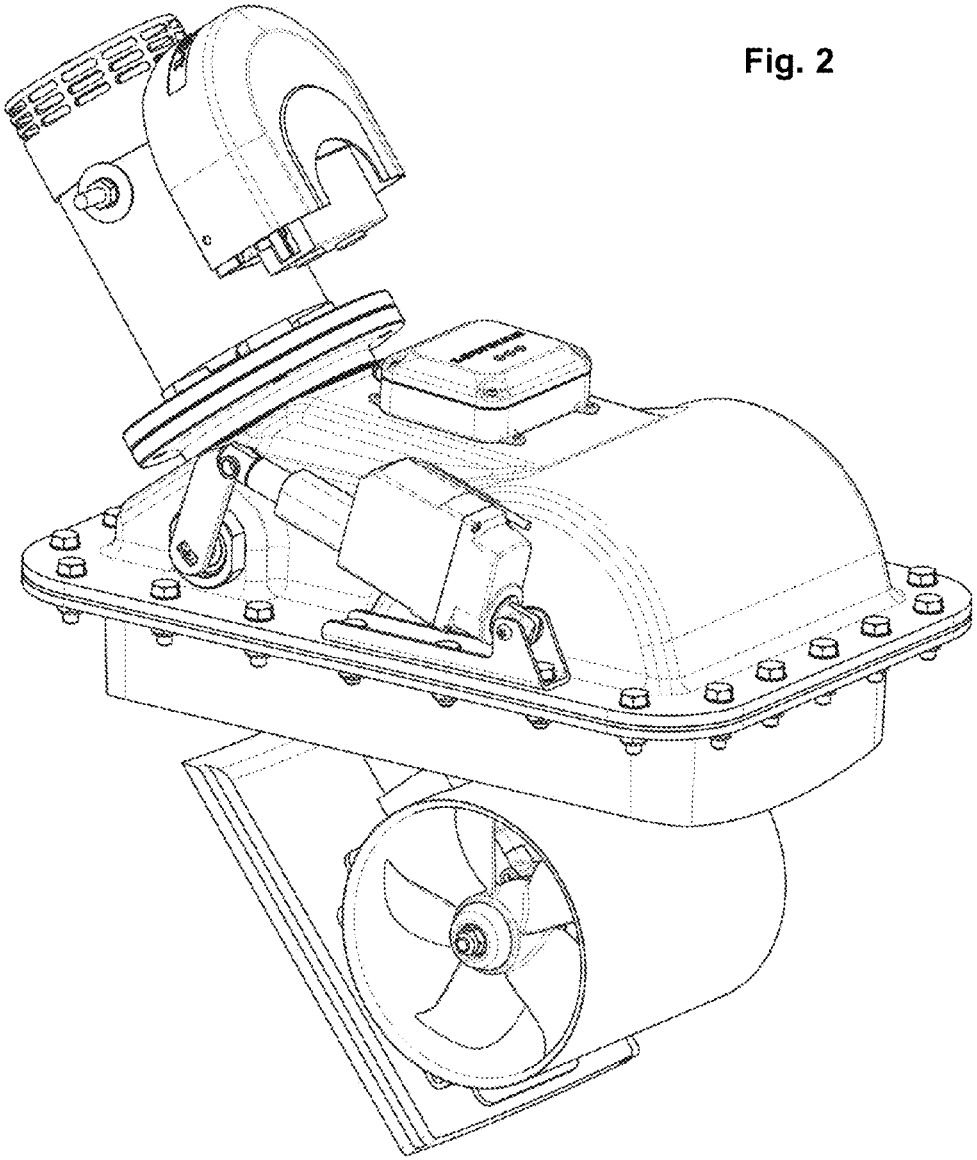
FIG. 2 shows an isometric view of the retractable thruster assembly, with the support assembly and propeller unit in a deployed configuration.
Figure 3:
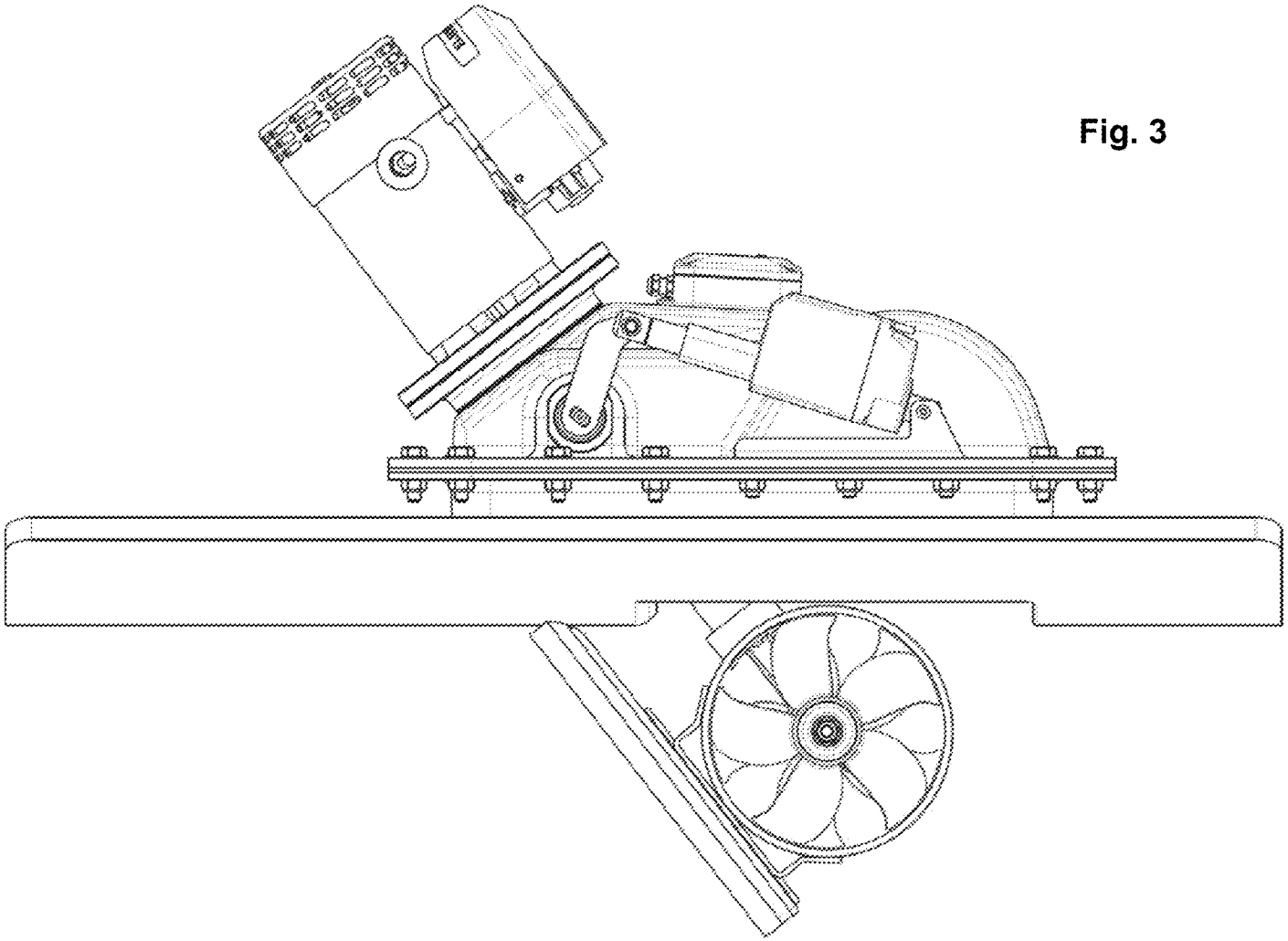
FIG. 3 shows a side view of the assembly of FIG. 1.

DETAILED DESCRIPTION OF THE PREFERRED EMBODIMENTS, AND FURTHER OPTIONAL FEATURES OF THE INVENTION

The drawings show one preferred embodiment of the invention. Accordingly, the drawings use the same reference numbers for the same features, and some features are identified with reference numbers in only some of the drawings.

According to the preferred embodiment of the invention as shown in FIG. 1-10, with particular reference to FIGS. 1, 4, 6, and 8, the retractable thruster has a housing 2 with a downwardly-facing bottom flange 4 intended to be fixed in a sealing engagement with a corresponding upwardly-facing flange 6 of an insert unit 7 located at an opening formed in a hull 8 of a marine vessel. Together, the hull 8, insert unit 7 and housing 2 provide a watertight seal against ingress of water.

Motor 10 is fixed with respect to the housing 2. Motor 10 has a rotor (not shown) with an axis of rotation at an angle of about 45° relative to a plane defined by downwardly-facing bottom flange 4. In turn, downwardly-facing bottom flange 4 is located substantially parallel to the hull 8 of the vessel. Where the hull is not planar, downwardly-facing bottom flange 4 is located substantially parallel to a tangent T to hull 8 of the vessel where the opening is formed. The disposition of the motor at an angle allows the motor to take up less space in the hull. The angle is preferably at least about 30°. Using an angle of less than about 30° would require that the drive shaft remains substantially folded when the propeller unit is in the deployed configuration. This reduces the efficiency of operation of the thruster assembly. The angle is preferably at most about 60°, in order to ensure that the space-saving advantages are achieved.

Ensuring that the motor is fixed with respect to the housing allows the position of the motor to remain stationary with respect to the housing and hull during operation. This reduces health and safety risks that would be associated with movement of the motor. Additionally, the space-saving advantages of the position and orientation of the motor are ensured. Furthermore, the associated wiring of the motor is not subjected to unnecessary movement, risking additional wear and tear. Still further, fixing of the motor relative to the housing allows a straightforward watertight seal to be interposed between the motor and the housing. A suitable seal can be a flange seal for example, between motor flange 9 and housing flange 11.

Drive shaft 12 connects motor 10 to propeller unit 14. Drive shaft 12 is a telescopic universal joint drive shaft.

Propeller unit 14 comprises a propeller shaft 16 with one propeller 18 fixed at each end, the drive shaft 12 engaging with gearing to drive the propeller shaft 16 at a location intermediate the propellers. The propeller unit 14 is housed in a tunnel 20.

Actuator 22 (which is hydraulic in this embodiment but may optionally be electric or pneumatic) is pivotably attached with respect to the housing 2 at actuator pivot 23, the actuator 22 being operable to extend and retract actuator rod 24. The position of the actuator also has a low profile in comparison with known thruster assemblies. Although the actuator can pivot during use (as explained below), preferably the actuator rod 24 of the actuator 22 subtends a maximum angle of up to about 30° with respect to the flange 4 of the housing 2. This has the advantage of saving space in the vessel.

Actuator rod 24 is pivotably attached at pivot 25 to crank 26. The crank is fixed to a rotatable shaft 28 at one end of the shaft. The shaft extends through the housing 2 via a rotatable seal 30. At its other end, the rotatable shaft is fixed to an intermediate crank 32, which in turn is pivotably attached at pivot 33 to rod 34. Rod 34 is pivotably attached at pivot 35 to a support assembly 36. The support assembly 36 comprises a pair of cooperating arms 36*a*, 36*b* which are disposed in parallel relation to each other, on either side of the drive shaft 12.

Rod 34 attaches to arm 36*a* at lever extension 38. Arm 36*a* is arranged to rotate around pivot 40, defining pivot axis A, on operation of the actuator 22. The support assembly 36 attaches to the tunnel 20 via a suitable connection at the ends of the arms 36*a*, 36*b*. In this way, arms 36*a*, 36*b* are constrained to move with each other.

Pivot 40 is formed between the arms 36*a*, 36*b* and respective arms 41*a*, 41*b* of bracket 41. Bracket 41 is fixed with respect to the housing 2. A space is defined between arms 41*a*, 41*b* of bracket 41 to accommodate the drive shaft 12.

Figure 4:
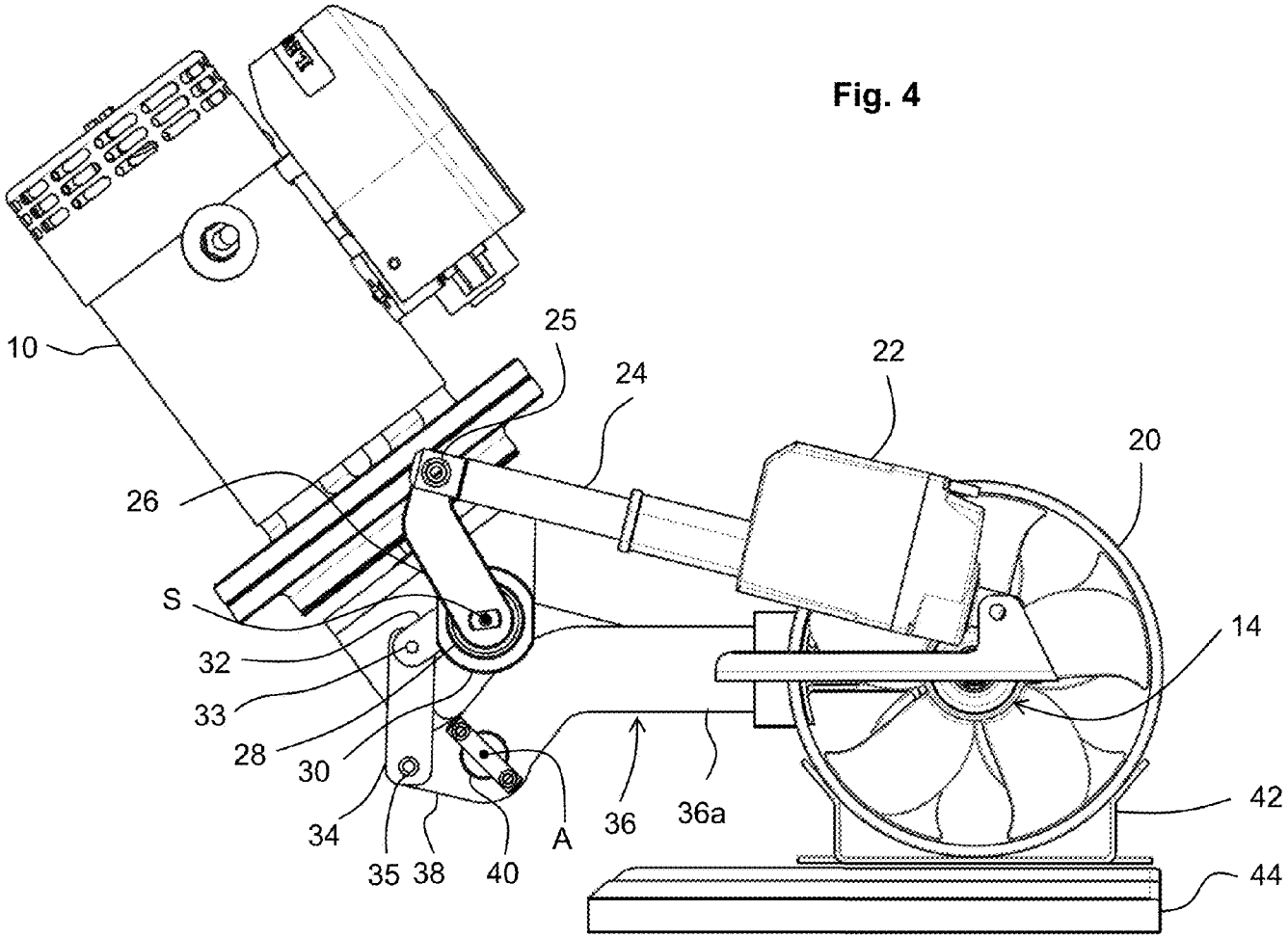
FIG. 4 shows a side view of the retractable thruster assembly, with the housing, hull, and hull-bonded insert unit not shown, with the support assembly and propeller unit in a storage configuration.
Figure 5:
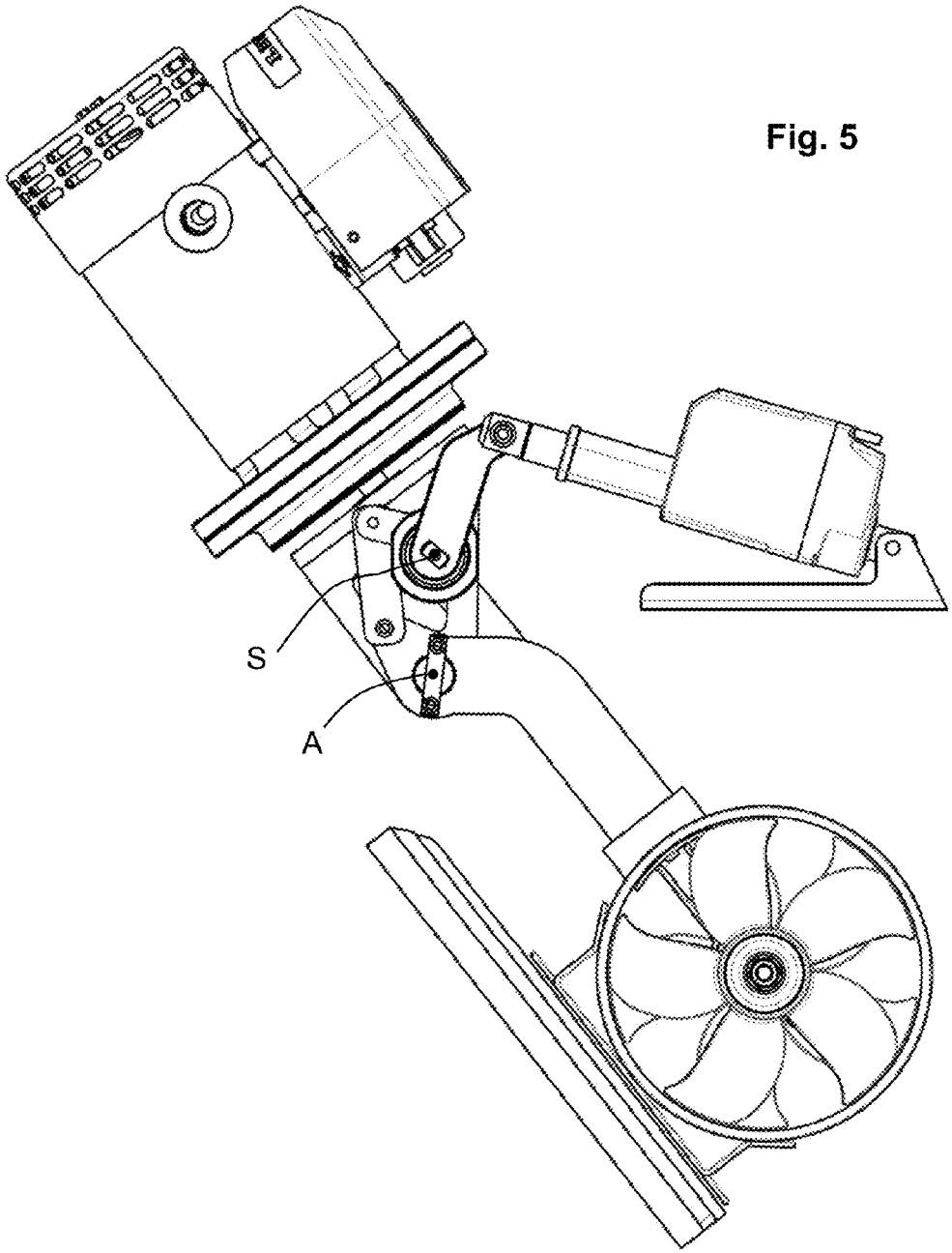
FIG. 5 shows a side view of the retractable thruster assembly, with the housing, hull, and hull-bonded insert unit not shown, with the support assembly and propeller unit in a deployed configuration.

Operation of the actuator therefore moves the tunnel 20 and the associated propellers 18 between the storage configuration (shown in FIG. 4) and the deployment configuration (shown in FIG. 5).

Folded bracket 42 is fixed to the tunnel 20. This is intended to have a cover 44 attached to it, in order to conform to the outer shape of the hull 8 when the thruster is in the storage configuration. Cover 44 has a surface finish (not shown) adapted to be similar to the surface finish (not shown) of the hull.

Electronic control box 46 is mounted to the housing 2, for housing control components (not shown) for the motor 10 and/or actuator 22.

Further details of the construction and operation of the thruster assembly according to the preferred embodiments will now be set out.

The flange-mounted arrangement for the thruster assembly reduces build time, and allows for easier installation and replacement of the retractable thruster. The material for the housing 2 is preferably ABS or PMMA. The housing 2 is preferably shaped so as to at least partially conform to the shape of the support assembly 36 and/or the tunnel 20. In this way, the profile of the thruster assembly within the hull is reduced. The sealing engagement is preferably achieved by arrangement of a gasket 48 between the corresponding flanges 4, 6.

The motor 10 is arranged for driving propeller unit, generally denoted with reference number 14, via a drive shaft 12. Propeller unit 14 comprises a propeller shaft 16 with propellers 18*a*, 18*b* disposed at opposite ends of the propeller shaft 16. Drive shaft 12 engages with gearing to drive the propeller shaft 16, in a known manner. The shape and size of the propellers 18*a*, 18*b* may be varied, and will affect the force and direction of the lateral thrust produced by the propeller unit for a particular rotational speed and rotational direction (as determined by operation of the motor 10).

The deployment of the support assembly 36 is best described with reference to FIGS. 4 and 5. Starting from the storage configuration illustrated in FIG. 4, actuator 22 is operated to retract actuator rod 24. This retraction of the actuator rod gives rise to clockwise rotation of the crank 26, which is transmitted via the rotatable shaft 28 passing through the rotatable seal 30 to the intermediate crank 32. Intermediate crank 32 therefore also rotates clockwise. Clockwise rotation of intermediate crank 32 pulls rod 34 upwardly. The upward motion of rod 34 rotates lever 38 clockwise about pivot axis A, thereby causing the support assembly 36 and propeller unit 14 also to rotate clockwise about pivot axis A, until the deployment configuration is reached as shown in FIG. 5.

Figure 6:
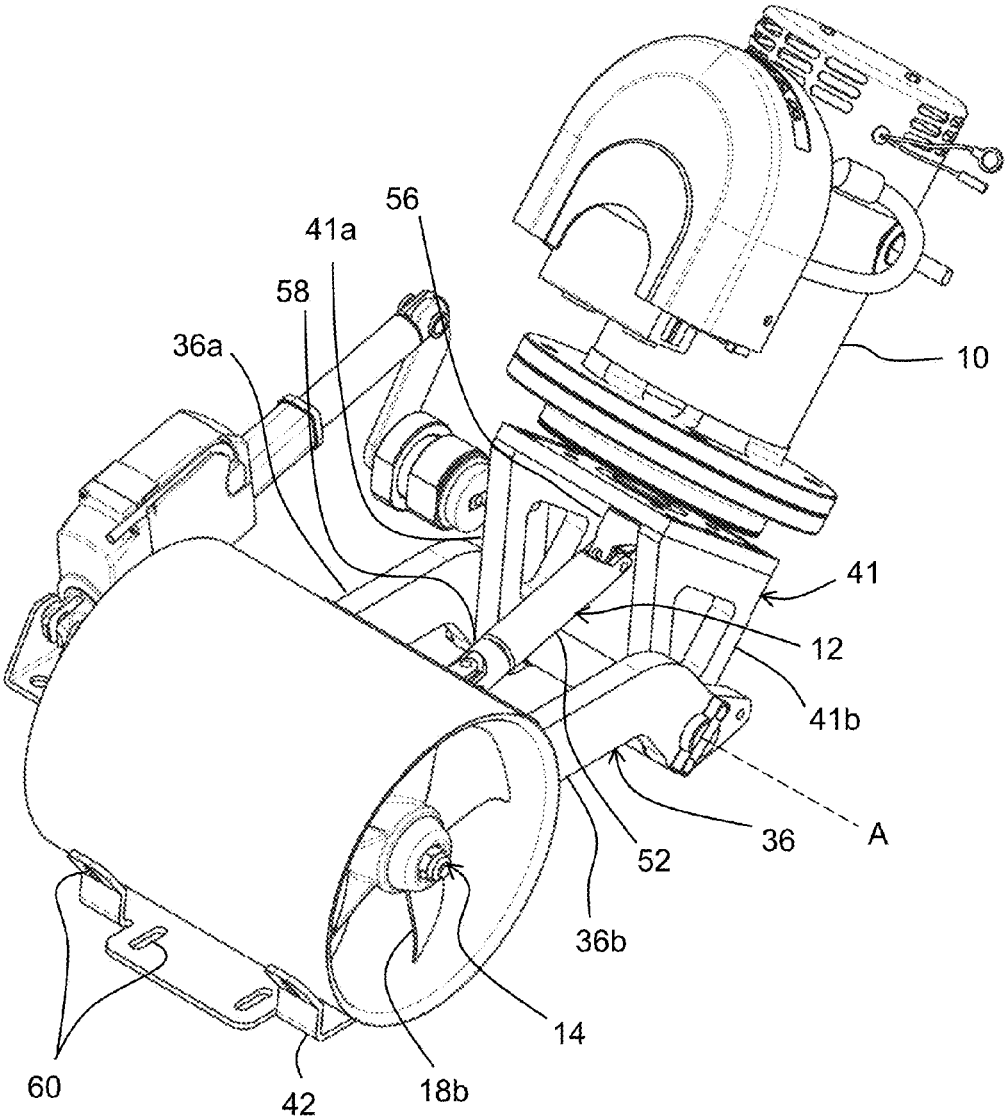
FIG. 6 shows an isometric view of the retractable thruster assembly of FIG. 4.
Figure 7:
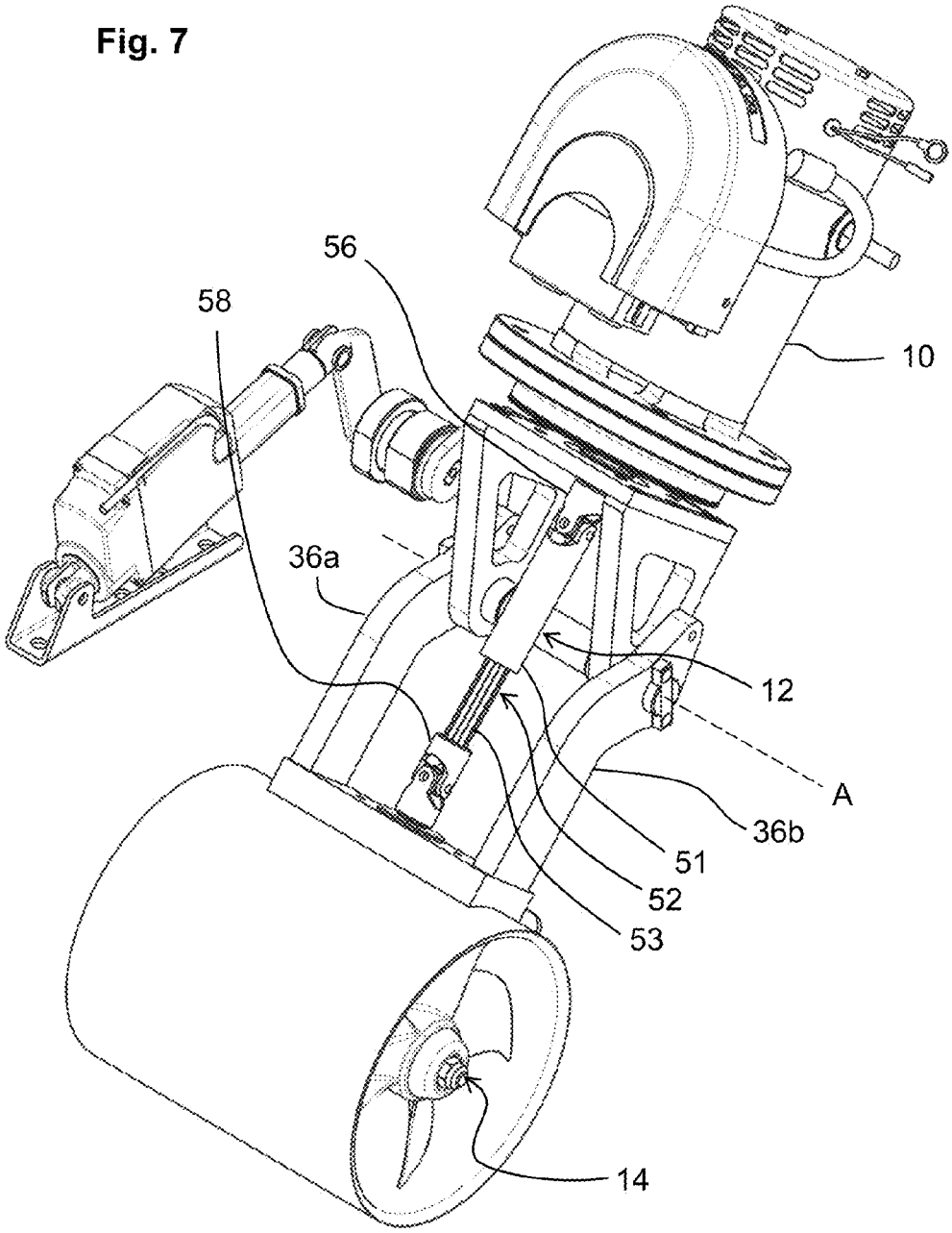
FIG. 7 shows an isometric view of the retractable thruster assembly of FIG. 5.
Figure 8:
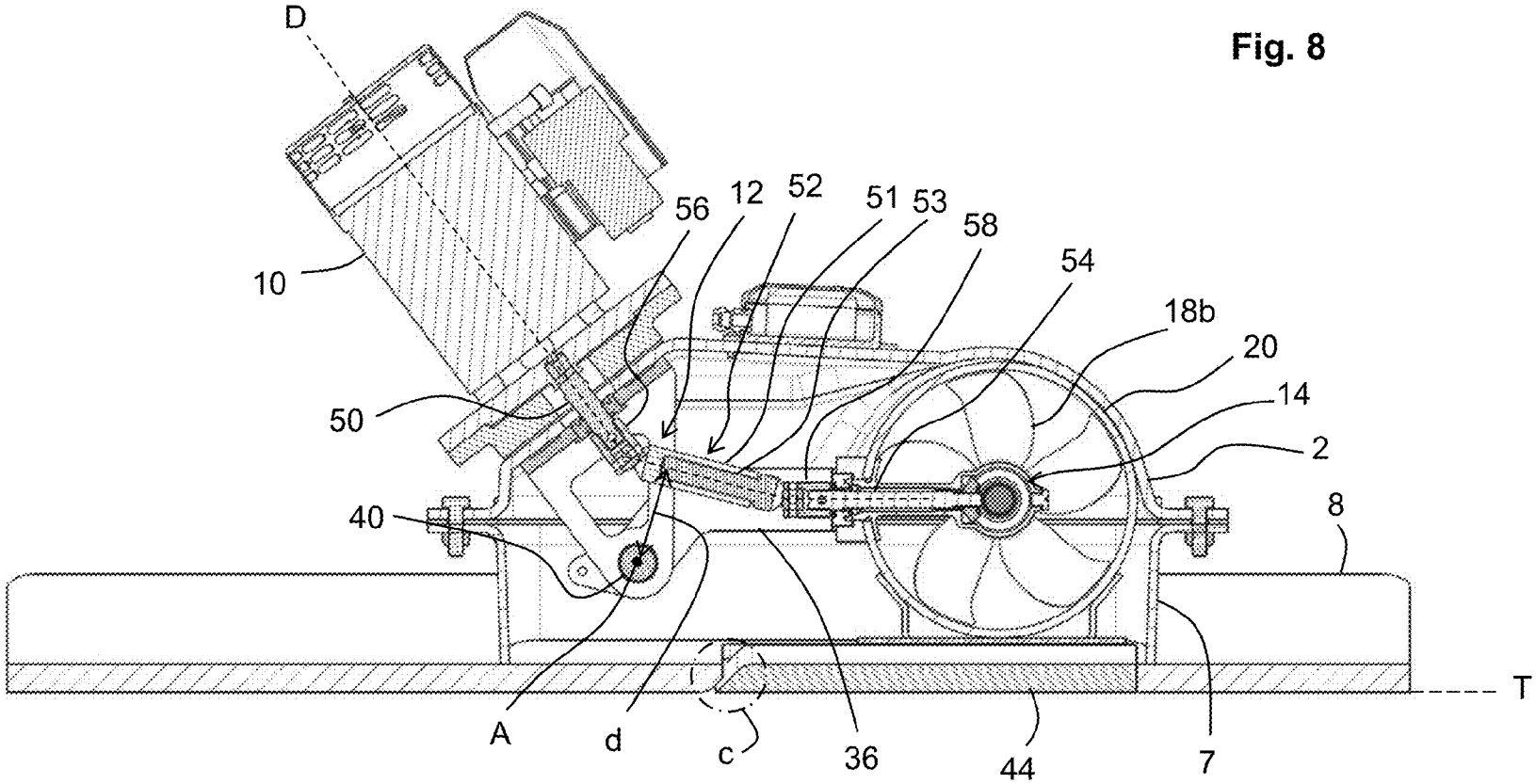
FIG. 8 shows a cross-sectional view of the retractable thruster assembly, with the support assembly and propeller unit in a storage configuration.

The drive shaft 12, as best seen in FIG. 7 and shown in cross section in FIG. 8, is a telescopic universal joint drive shaft, comprising a driving shaft 50 connected to the motor 10, a telescopically extendable intermediate shaft assembly 52, a driven shaft 54 connected to the propeller unit 14, and two universal joints 56, 58, arranged respectively between the driving shaft 50 and the intermediate shaft assembly 52, and the intermediate shaft assembly 52 and the driven shaft 54. The telescopically extendable intermediate shaft assembly 52 comprises a splined sleeve 51 cooperating with a splined shaft 53. This setup allows for transmission of torque from motor to propeller, whilst allowing changes in length of the drive shaft 12, and also allows folding of the drive shaft at the universal joints 56, 58, to accommodate the storage configuration. The change in length of the drive shaft during movement between storage and deployment configurations can be seen by comparing FIG. 6 to FIG. 7. During this movement, the splined shaft 53 extends from the splined sleeve 51, allowing the drive shaft 12 to lengthen. When in the deployment configuration, the drive shaft 12 is substantially rectilinear, allowing for efficient power transmission from motor 10 to propeller unit 14.

Figure 9:
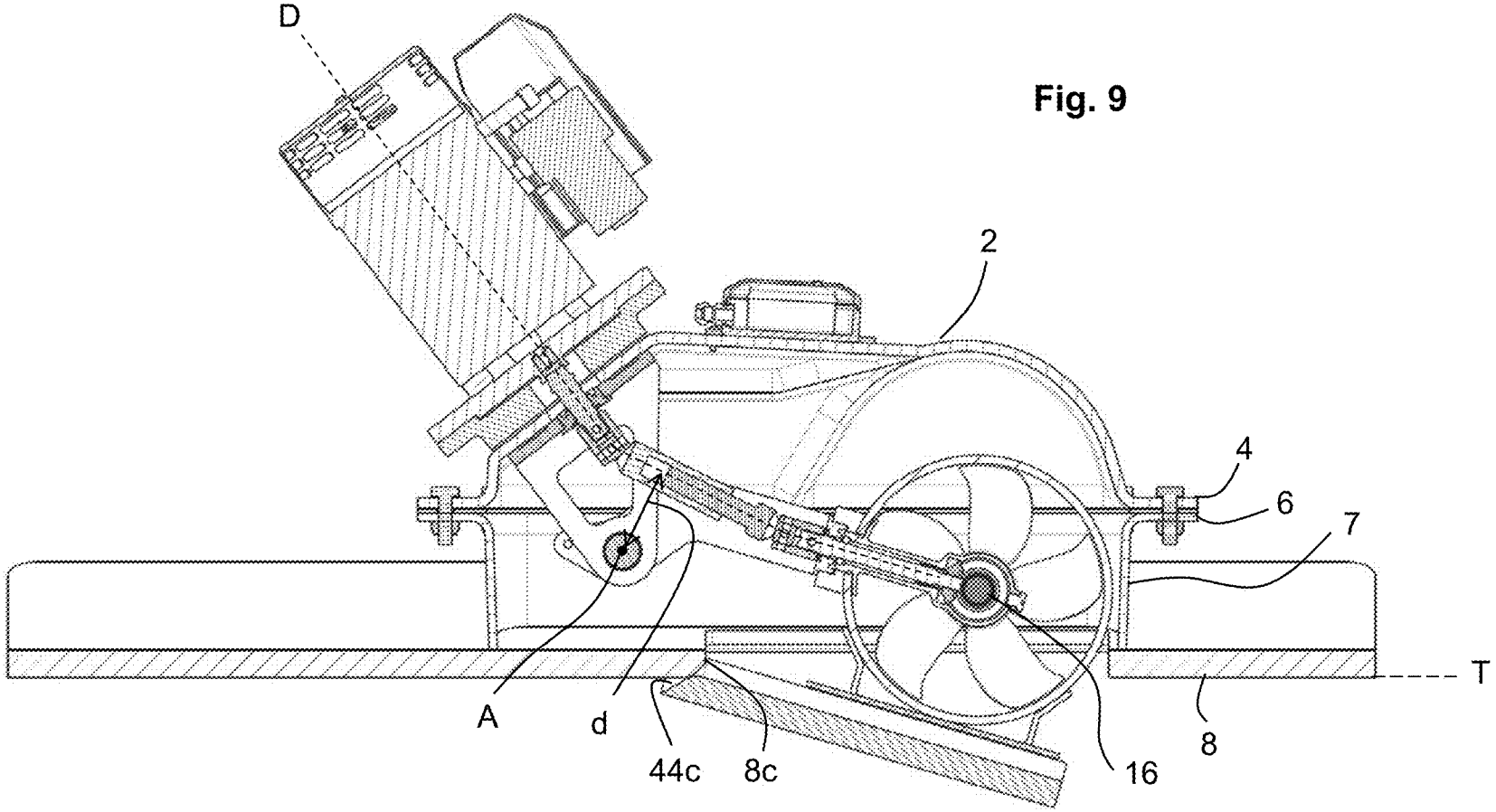
FIG. 9 shows a cross-sectional view of the retractable thruster assembly, with the support assembly and propeller unit in a partially-deployed configuration.
Figure 10:
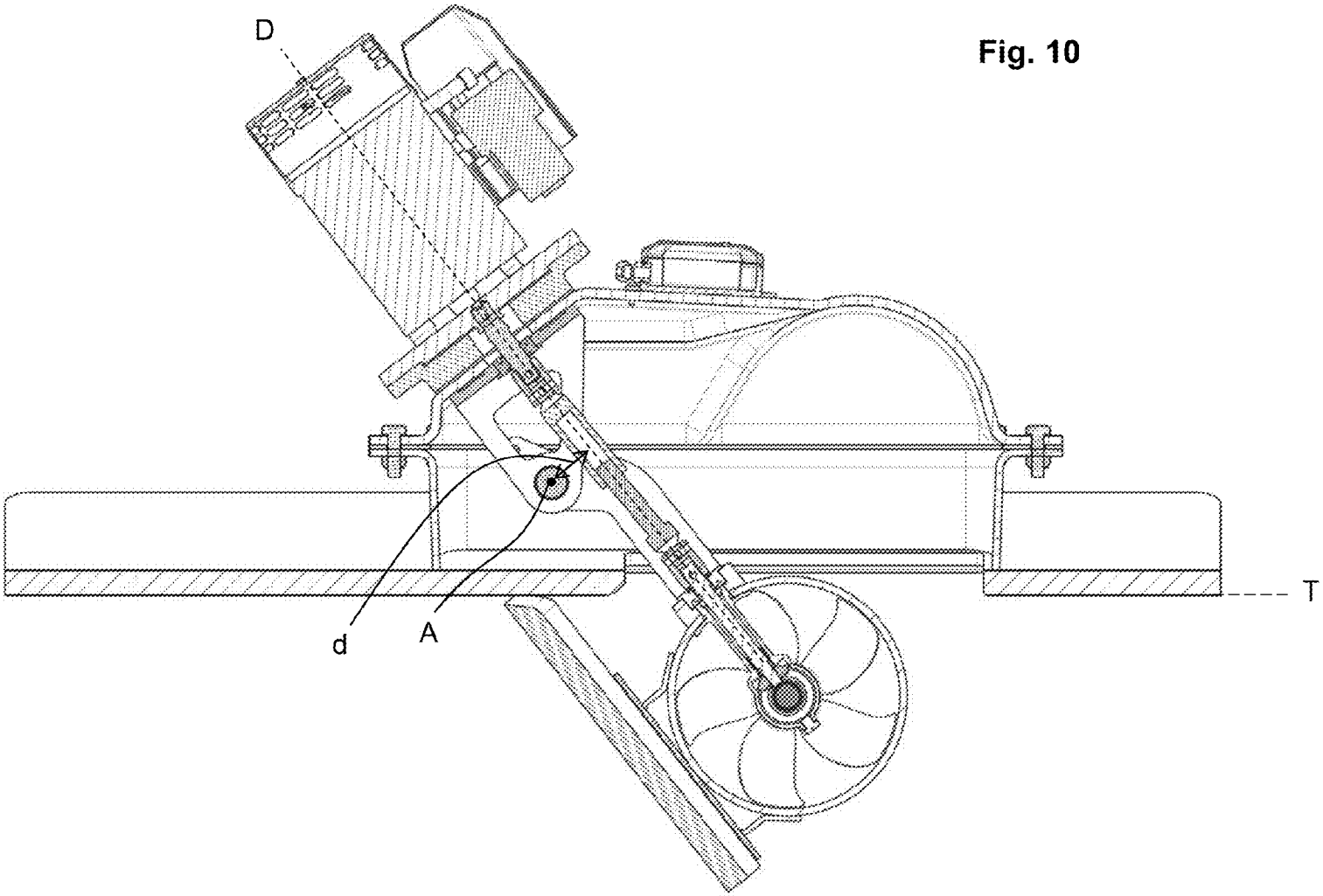
FIG. 10 shows a cross-sectional view of the retractable thruster assembly, with the support assembly and propeller unit in a deployed configuration.

The drive path D is indicated by a dashed line in FIGS. 8-10.

The pivot axis A for the support assembly sits at a location which is low relative to the remainder of the thruster assembly, and close to the hull of the vessel. Preferably, pivot axis A is located within the depth of the insert unit 7 bonded to the hull of the vessel, as seen in FIG. 8-10. The effect of having this low pivot axis on the path of travel of the support assembly is that the cover 44 and tunnel 20 can move almost perpendicularly to the hull from the retracted configuration, at the start of deployment. This means that only a small amount of chamfer is needed, as shown in region C indicated in FIG. 8, for the cover 44 and the hull 8, to accommodate the movement of the cover relative to the hull whilst still allowing the cover 44 to make a snug fit in the opening in the hull in the storage configuration. A snug fit is preferred in order to reduce drag during normal use of the vessel. The close approach of chamfer portions 8*c* of the hull 8 and 44*c* of the cover 44 is shown in FIG. 9.

As the drive shaft 12 moves with the propeller unit 14, the closest point on the drive path D to the pivot axis A changes position on the drive path D. The distance between the pivot axis A and the closest point is indicated by distance d in FIGS. 8-10. As can be seen, the closest point on the drive path D to the pivot axis A remains inboard of pivot axis A, whether the propeller unit is in the storage or deployment configurations.

The folded bracket 42 attached to the tunnel 20 has an arrangement of slots 60, as seen in FIG. 6, to allow adjustment of the position of the cover 44 relative to the tunnel 20. It is not intended that this adjustment takes place during operation of the retractable thruster.

Electronic control box 46 disposed on the housing 2 of the retractable thruster controls operation of the retractable thruster. The electronic control box is connectable to an input device, for example as part of a control panel (not shown) of the vessel. This input device, which preferably comprises either a joystick panel or touch-button panel, can be used to operate the retractable thruster by a person manoeuvring the vessel to which the retractable thruster is fitted.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

All references referred to above are hereby incorporated by reference.

The invention claimed is:

1. A thruster assembly for a marine vessel comprising:

a propeller unit, a motor, a drive shaft linking the motor with the propeller unit to drive the propeller unit, the drive shaft being foldable and defining a drive path between the motor and the propeller unit, a housing for locating the propeller unit in a storage configuration, the motor being fixed with respect to the housing, the housing being adapted to be fixed with respect to an opening in a hull of the marine vessel, an actuator operable to move the propeller unit from the storage configuration to a deployment configuration in a direction from inboard to outboard, the propeller unit being extended from the hull for use in the deployment configuration, wherein the propeller unit is supported by a support assembly which is pivotable relative to the housing about a pivot axis, a closest point on the drive path being defined as a point on the drive path which is closest to the pivot axis, the pivot axis being located in a position which is outboard of the closest point on the drive path of the drive shaft when the propeller unit is in the storage configuration and when the propeller unit is in the deployment configuration.

2. The thruster assembly of claim 1 wherein the drive shaft is foldable at least at a location closer to the motor than the closest point on the drive path.

3. The thruster assembly of claim 1 wherein the closest point on the drive path moves as the thruster assembly is moved from the storage configuration to the deployment configuration, and the movement direction is in a direction along the drive path from the motor towards the propeller unit.

4. The thruster assembly of claim 1 wherein the drive shaft is telescopic, and comprises a telescopically extendable intermediate shaft assembly.

5. The thruster assembly of claim 4 wherein the telescopically extendable intermediate shaft assembly comprises a splined sleeve cooperating with a splined shaft, the splined shaft being extendable from the splined sleeve whilst maintaining torque transmission from the splined sleeve to the splined shaft.

6. The thruster assembly of claim 1 wherein the actuator is operable to drive a rotatable actuator shaft, rotatable about an actuator shaft rotation axis, the actuator shaft extending through the housing via a watertight rotatable seal.

7. The thruster assembly of claim 6 wherein a mechanical linkage comprising an arrangement of at least one crank, at least one pivot, and at least one lever is provided between the actuator shaft and the support assembly.

8. The thruster assembly of claim 1 wherein the movement of the propeller unit is substantially perpendicular to a tangent to the hull of the marine vessel where the opening is formed, at the start of deployment.

9. The thruster assembly of claim 1 wherein the motor is fixed at an angle of between 30° and 60° with respect to a tangent to the hull of the marine vessel where the opening is formed.

10. The thruster assembly of claim 1 wherein the propeller unit sits within a tunnel, and there is a cover, connected to the tunnel via a connecting means, arranged to cover the opening in the hull of the marine vessel, when the thruster assembly is in the storage configuration.

11. The thruster assembly of claim 10 wherein the connecting means has an arrangement of slots to allow adjustment of the position of the cover relative to the tunnel.

12. A thruster assembly for a marine vessel comprising:

a propeller unit;

a motor;

a drive shaft linking the motor with the propeller unit to drive the propeller unit;

a housing for locating the propeller unit in a storage configuration, the motor being fixed with respect to the housing, the housing having a flange configured to be fixed with respect to an opening in a hull of the marine vessel, wherein when the housing is oriented upright, the flange is downwards-facing;

an actuator operable to move the propeller unit from the storage configuration to a deployment configuration in a direction from inboard to outboard, the propeller unit being extended from the hull for use in the deployment configuration, wherein the propeller unit is supported by a support assembly which is pivotable relative to the housing about a pivot axis, wherein when the housing is oriented upright, the pivot axis is located in a position downwardly from the flange of the housing.

13. The thruster assembly of claim 12 wherein the downwards-facing flange of the housing is adapted to be fixed in a sealing engagement with an upwards-facing flange formed in an insert unit suitable for bonding into the hull of the marine vessel at the opening in the hull of the marine vessel.

14. The thruster assembly of claim 12 wherein the drive shaft is telescopic, and comprises a telescopically extendable intermediate shaft assembly.

15. The thruster assembly of claim 12 wherein the actuator is operable to drive a rotatable actuator shaft, rotatable about an actuator shaft rotation axis, the actuator shaft extending through the housing via a watertight rotatable seal.

16. The thruster assembly of claim 15 wherein a mechanical linkage comprising an arrangement of at least one crank, at least one pivot, and at least one lever is provided between the actuator shaft and the support assembly.

17. The thruster assembly of claim 12 wherein the movement of the propeller unit is substantially perpendicular to a tangent to the hull of the marine vessel where the opening is formed, at the start of deployment.

18. The thruster assembly of claim 12 wherein the motor is fixed at an angle of between 30° and 60° with respect to a tangent to the hull of the marine vessel where the opening is formed.

19. The thruster assembly of claim 12 wherein the propeller unit sits within a tunnel, and there is a cover, connected to the tunnel via a connecting means, arranged to cover the opening in the hull of the marine vessel, when the thruster assembly is in the storage configuration.

20. The thruster assembly of claim 19 wherein the connecting means has an arrangement of slots to allow adjustment of the position of the cover relative to the tunnel.

21. A thruster assembly for a marine vessel comprising:

a propeller unit;

a motor;

a drive shaft linking the motor with the propeller unit to drive the propeller unit;

a housing for locating the propeller unit in a storage configuration, the motor being fixed with respect to the housing, the housing being adapted to be fixed with respect to an opening in a hull of the marine vessel;

an actuator operable to drive a rotatable actuator shaft, rotatable about an actuator shaft rotation axis, to move the propeller unit from the storage configuration to a deployment configuration in a direction from inboard to outboard, the propeller unit being extended from the hull for use in the deployment configuration, wherein the propeller unit is supported by a support assembly which is pivotable relative to the housing about a pivot axis, the pivot axis being located in a position which is outboard of the actuator shaft rotation axis.

22. The thruster assembly of claim 21 wherein the drive shaft is telescopic, and comprises a telescopically extendable intermediate shaft assembly.

23. The thruster assembly of claim 22 wherein the telescopically extendable intermediate shaft assembly comprises a splined sleeve cooperating with a splined shaft, the splined shaft being extendable from the splined sleeve whilst maintaining torque transmission from the splined sleeve to the splined shaft.

24. The thruster assembly of claim 21 wherein the actuator is operable to drive a rotatable actuator shaft, rotatable about an actuator shaft rotation axis, the actuator shaft extending through the housing via a watertight rotatable seal.

25. The thruster assembly of claim 24 wherein a mechanical linkage comprising an arrangement of at least one crank, at least one pivot, and at least one lever is provided between the actuator shaft and the support assembly.

26. The thruster assembly of claim 21 wherein the movement of the propeller unit is substantially perpendicular to a tangent to the hull of the marine vessel where the opening is formed, at the start of deployment.

27. The thruster assembly of claim 21 wherein the motor is fixed at an angle of between 30° and 60° with respect to a tangent to the hull of the marine vessel where the opening is formed.

28. The thruster assembly of claim 1 wherein the propeller unit sits within a tunnel, and there is a cover, connected to the tunnel via a connecting means, arranged to cover the opening in the hull of the marine vessel, when the thruster assembly is in the storage configuration.

29. The thruster assembly of claim 28 wherein the connecting means has an arrangement of slots to allow adjustment of the position of the cover relative to the tunnel.

30. A marine vessel having located in its hull a thruster assembly comprising:

a propeller unit, a motor, a drive shaft linking the motor with the propeller unit to drive the propeller unit, the drive shaft being foldable and defining a drive path between the motor and the propeller unit, a housing for locating the propeller unit in a storage configuration, the motor being fixed with respect to the housing, the housing being adapted to be fixed with respect to an opening in a hull of the marine vessel, an actuator operable to move the propeller unit from the storage configuration to a deployment configuration in a direction from inboard to outboard, the propeller unit being extended from the hull for use in the deployment configuration, wherein the propeller unit is supported by a support assembly which is pivotable relative to the housing about a pivot axis, a closest point on the drive path being defined as a point on the drive path which is closest to the pivot axis, the pivot axis being located in a position which is outboard of the closest point on the drive path of the drive shaft when the propeller unit is in the storage configuration and when the propeller unit is in the deployment configuration.

31. A method for installing a retractable thruster assembly into a marine vessel, the retractable thruster assembly comprising:

a propeller unit, a motor, a drive shaft linking the motor with the propeller unit to drive the propeller unit, the drive shaft being foldable and defining a drive path between the motor and the propeller unit, a housing for locating the propeller unit in a storage configuration, the motor being fixed with respect to the housing, the housing being adapted to be fixed with respect to an opening in a hull of the marine vessel, an actuator operable to move the propeller unit from the storage configuration to a deployment configuration in a direction from inboard to outboard, the propeller unit being extended from the hull for use in the deployment configuration, wherein the propeller unit is supported by a support assembly which is pivotable relative to the housing about a pivot axis, a closest point on the drive path being defined as a point on the drive path which is closest to the pivot axis, the pivot axis being located in a position which is outboard of the closest point on the drive path of the drive shaft when the propeller unit is in the storage configuration and when the propeller unit is in the deployment configuration, the method including the step of providing an opening in a hull of the marine vessel and fixing the housing of the retractable thruster assembly with respect to the opening.

32. A method according to claim 31 wherein the method includes the step of bonding an insert unit into the hull of the vessel at the opening in the hull of the vessel, and the housing is fixed in a sealing engagement with the insert unit.

33. A kit of parts, comprising a retractable thruster assembly and an insert unit, the insert unit being for installation at a corresponding hole formed in a hull of a marine vessel, the insert unit and the housing being adapted to be sealingly attached to each other, wherein the retractable thruster assembly comprises:

a propeller unit, a motor, a drive shaft linking the motor with the propeller unit to drive the propeller unit, the drive shaft being foldable and defining a drive path between the motor and the propeller unit, a housing for locating the propeller unit in a storage configuration, the motor being fixed with respect to the housing, the housing being adapted to be fixed with respect to an opening in a hull of the marine vessel, an actuator operable to move the propeller unit from the storage configuration to a deployment configuration in a direction from inboard to outboard, the propeller unit being extended from the hull for use in the deployment configuration, wherein the propeller unit is supported by a support assembly which is pivotable relative to the housing about a pivot axis, a closest point on the drive path being defined as a point on the drive path which is closest to the pivot axis, the pivot axis being located in a position which is outboard of the closest point on the drive path of the drive shaft when the propeller unit is in the storage configuration and when the propeller unit is in the deployment configuration.

* * * * *